US008579318B2

(12) United States Patent
Hall

(10) Patent No.: US 8,579,318 B2
(45) Date of Patent: Nov. 12, 2013

(54) STRAP FOR SNOWBOARD BINDING

(75) Inventor: Jacob R. Hall, Draper, UT (US)

(73) Assignee: K-2 Corporation, Seattle, WA (US)

( * ) Notice: Subject to any disclaimer, the term of this patent is extended or adjusted under 35 U.S.C. 154(b) by 85 days.

(21) Appl. No.: 13/178,346

(22) Filed: Jul. 7, 2011

(65) Prior Publication Data

US 2012/0007339 A1 Jan. 12, 2012

Related U.S. Application Data

(60) Provisional application No. 61/363,281, filed on Jul. 12, 2010.

(51) Int. Cl.
*A63C 9/12* (2012.01)

(52) U.S. Cl.
USPC ..... 280/617; 280/619; 280/623; 280/634

(58) Field of Classification Search
None
See application file for complete search history.

(56) References Cited

U.S. PATENT DOCUMENTS

| | | | | |
|---|---|---|---|---|
| 3,378,274 | A | 4/1968 | Poppen | |
| 3,900,204 | A | 8/1975 | Weber | |
| 5,857,700 | A | 1/1999 | Ross | |
| D455,187 | S * | 4/2002 | Janisch | D21/773 |
| 6,520,511 | B2 * | 2/2003 | Gonthier | 280/11.36 |
| 6,679,515 | B2 | 1/2004 | Carrasca | |
| 6,938,904 | B2 * | 9/2005 | Dalgaard | 280/14.21 |
| 7,021,649 | B2 | 4/2006 | Pascal | |
| 7,048,295 | B2 | 5/2006 | Davies | |
| 7,237,793 | B2 | 7/2007 | Messmer | |
| 7,281,730 | B2 | 10/2007 | Davies | |
| 7,487,992 | B2 | 2/2009 | Pascal | |
| 7,887,082 | B2 | 2/2011 | Caslowitz | |
| 8,226,108 | B2 * | 7/2012 | Pontano et al. | 280/618 |
| 2002/0084604 | A1 * | 7/2002 | Phillips et al. | 280/14.21 |
| 2002/0089151 | A1 | 7/2002 | Carrasca | |
| 2006/0175802 | A1 | 8/2006 | Maravetz | |
| 2007/0108735 | A1 | 5/2007 | Walker | |
| 2007/0108756 | A1 | 5/2007 | Laakso | |
| 2008/0042401 | A1 | 2/2008 | Walker | |
| 2008/0048416 | A1 | 2/2008 | Walker | |
| 2008/0066837 | A1 | 3/2008 | Kvinge | |
| 2008/0104864 | A1 | 5/2008 | Hall | |

FOREIGN PATENT DOCUMENTS

EP 1491240 A1 12/2004

OTHER PUBLICATIONS

McIntosh, P., "Snowboarding Wild Rides," English Teaching Forum 48(1):35-43, 2010.

* cited by examiner

*Primary Examiner* — Jeffrey J Restifo
*Assistant Examiner* — Erez Gurari
(74) *Attorney, Agent, or Firm* — Christensen O'Connor Johnson Kindness PLLC

(57) ABSTRACT

A geometry-shifting strap for a binding having a baseplate is disclosed. The geometry-shifting strap is shiftable between a closed position wherein the distal end of the geometry-shifting strap is biased or disposed over the baseplate, and an open position wherein the distal end of the strap is not over the baseplate. The strap includes at least one arcuate element that biases the strap to the closed position when the arcuate element is in a concave configuration, and biases the strap to the open position when the arcuate element is in a convex configuration.

16 Claims, 14 Drawing Sheets

STRAP FOR SNOWBOARD BINDING

CROSS-REFERENCE TO RELATED APPLICATION

This application claims the benefit of Provisional Application No. 61/363,281, filed Jul. 12, 2010, the entire disclosure of which is hereby incorporated by reference herein.

BACKGROUND

In snowboarding a rider descends a snowy slope on a single gliding board that is attached to the rider's feet using special boots set onto bindings mounted on the snowboard. Modern snowboarding developed in the 1960s and the 1970s and became a Winter Olympic Sport in 1998. Although a relatively new sport, snowboarding now ranks second only to skiing among winter sports in the United States. The genesis of the sport has been attributed to Sherman Poppen, an engineer in Muskegon, Mich. who invented a toy for his daughter in 1965 by connecting two skis together side-by-side and attaching a rope to one end to provide control while gliding downhill. Dubbed the "snurfer," the toy proved so popular among his daughter's friends that Poppen licensed the idea to a manufacturer that sold about a million snurfers over the next decade. In 1968 Poppen received U.S. Pat. No. 3,378,274 for a "Surf-Type Snow Ski."

U.S. Pat. No. 3,900,204, to Weber and directed to a "Mono-Ski," issued on Aug. 19, 1975. The snowboard, or mono-ski, disclosed therein featured releasable boot bindings to secure the rider's boots to the snowboard.

Snowboarding's growing popularity is reflected in the fact that "In 1985 only seven percent of U.S. ski areas allowed snowboarding, a situation reflected in Europe . . . . Now, virtually all ski resorts in North America and Europe welcome snowboarders, and many have constructed special terrain parts with jumps and other features that encourage boarders to hone their skills and showcase their techniques." *Snowboarding Wild Rides*, Phyllis McIntosh, English Teaching Forum, No. 1, pages 35-42.

In modern snowboarding a rider stands with both feet fixed to a single board, and the gravity-propelled rider negotiates a path down a snow-covered slope. A particularly important aspect of controlling the snowboard is rotating the snowboard about its longitudinal axis, thereby selecting which lateral edge of the snowboard engages the snow, the angle of engagement, and the orientation of the snowboard with respect to the slope of the terrain.

In order to control the orientation of the snowboard, the rider wears boots that are firmly secured to the snowboard transverse to the longitudinal axis of the snowboard. In this stance, the rider can raise the toe-side edge of the snowboard by leaning backward and rotating his/her feet, for example, and can rotate the board in pitch, yaw, and roll by appropriate foot movement. To enable precise control of the snowboard, the rider's boots are firmly attached to the board with snowboard bindings. Many different binding mechanisms have been developed. Snowboard bindings are generally categorized as either strap bindings (also called conventional bindings) wherein a pair of frames having straps for releasably securing the rider's boots is attached to the board, and step-in bindings wherein typically a cleat mechanism is integrated into the sole of the boots and a complementary cleat-engagement mechanism is attached to the snowboard.

A strap binding typically includes a baseplate that receives the sole of the boot, a high back that extends upwardly from the baseplate, and strap assemblies for tightly and releasably securing the boots to the binding. The base portion attaches to the board, frequently in an adjustable manner such that the rider can select a particular angle between the boot axis and the board axis, and will generally include integral side walls that provide lateral support to the attached boot. The high back is important particularly when the rider is using soft boots, as it enables the rider to raise the toe-side edge of the board by leaning backwardly against the high back portion. Typically, two strap assemblies are attached to the baseplate side walls. The strap assemblies are configured to extend over the rider's boots to secure the snowboard boots to the snowboard. The first pair of straps extends generally around the ankle portion of the boot, and the second pair extends generally over the toe portion of the boot.

A common problem encountered with strap bindings is that as the rider mounts the snowboard by stepping onto the base portion of the frame, the straps tend to get in the way, sometimes becoming trapped behind or underneath the rider's boots, requiring the rider to adjust her feet and attempt to pull the straps out and over the boots. This task can be particularly difficult and frustrating when the rider is mounting a snowboard in the field, for example, after dismounting the snowboard to traverse a level portion of a run. In this case, the boots, straps, binding, and snowboard may be covered with snow, the rider is typically wearing gloves and bulky clothing, and the snowboard and rider may be situated on an inclined and/or slippery snowy field. Under these conditions, properly orienting and securing the binding straps can be particularly challenging.

In addition to the physical difficulties associated with properly mounting the snowboard, physical damage and undesirable wear and tear can be caused to the strap assembly. The straps, and particularly the clasping mechanism for securing the straps, can be damaged, for example, if the rider inadvertently steps on the straps or imposes sharp bends in the straps between the boot and the high back portion of the frame. Moreover, the process of pulling the straps (including a clasp mechanism) out from between the boot and the frame can result in unnecessary stresses and strains in the strap assembly.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

A novel strap having a geometry-shifting element that is operable to selectively bias the strap to either of two neutral positions (e.g., an open position or a closed position) is disclosed. The strap is suitable for use in snowboard bindings, to overcome the hassle and potential damage associated with current strap designs. In a current embodiment, the strap includes an elongate distal portion, and a proximal head that is configured to be attached to a binding baseplate or the like. A load-bearing portion connects the head to the distal portion, and a geometry-shifting element extends between the distal portion and the head. The geometry shifting element is configured to shift between two different positions, a concave geometry wherein the geometry-shifting element biases the distal portion towards the closed position, and a convex geometry wherein the geometry-shifting element biases the distal portion towards the open position. The strap may be formed as a unitary, ladder strap.

In an embodiment, the geometry-shifting element is one or more elongate arms that engage the head such that the arms are in an arcuate, flexed configuration. For example, the elongate arms may include foot portions that are sized and shaped to be retained in corresponding recesses in the strap head. If the elongate arms are too long, then they will flex to an arcuate shape when they are inserted into the recesses. The arcuate shape has two neutral positions, convex and concave. In a current embodiment, the foot portions have transverse recesses that engage corresponding transverse ridges in the head recesses.

A strap assembly is also disclosed that is suitable for use in a strap-type snowboard binding of the type having a baseplate, a heel loop, and a highback. The strap assembly includes (i) a medial mounting strap, (ii) a center strap portion with a buckle assembly, the center strap portion being adjustably attached to the medial mounting strap, and (iii) a lateral mounting strap configured to releasably engage the buckle assembly. Either or both of the medial mounting straps and the lateral mounting strap are configured to include a geometry-shifting element that extends from the distal portion of the strap to the head, and is configured to be selectively shifted by the user between a closed position wherein the distal portion is biased towards the baseplate, and an open position wherein the distal portion is biased away from the baseplate.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Currently preferred embodiments of bindings and binding straps in accordance with the present invention that are suitable for use with gliding boards such as snowboards will now be described with reference to the figures, wherein like numbers indicate like parts.

Figure 1:
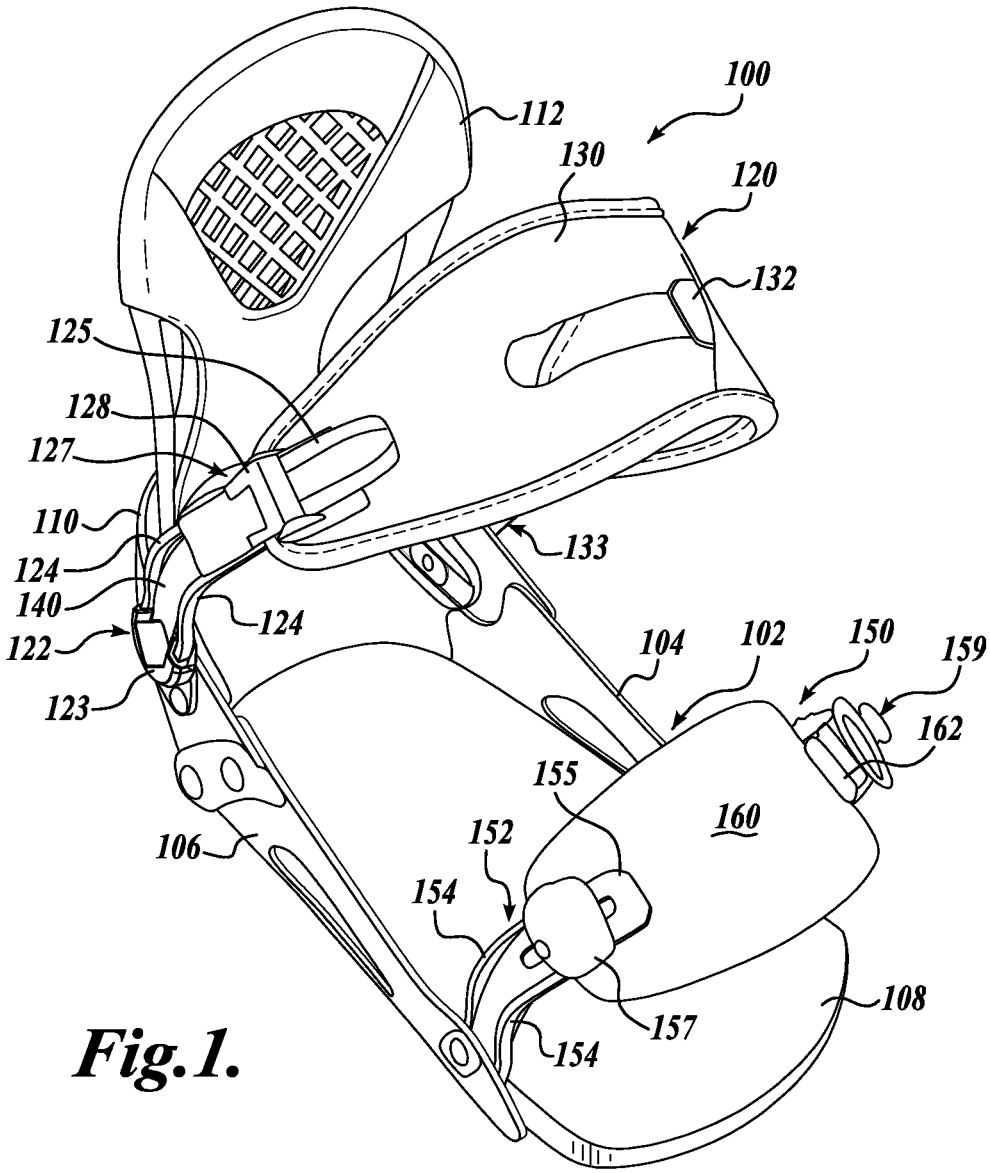
FIG. 1 is a perspective view of a snowboard binding with geometry-shifting strap assemblies in accordance with the present invention, and showing the strap assemblies in a closed position.

For example, FIG. 1 is a perspective view of a snowboard strap-type binding 100. The binding 100 includes a baseplate assembly 102, which includes a lateral sidewall 104, a medial sidewall 106, a footpad 108, a heel loop 110 that is adjustably attached to the lateral and medial sidewalls 104, 106, and a highback 112 that is pivotably attached to the heel loop 110. Binding components such as the baseplate 102, heel loop 110, and highback 112 are known in the art, and therefore will not be further described.

The binding 100 further includes an instep strap assembly 120 having a geometry-shifting element that is configured to selectively bias the associated strap to either a neutral open position or a neutral closed position, as discussed below. A toe strap assembly 150 optionally includes a similar geometry-shifting element. The geometry-shifting aspect of the straps will be better understood with reference to the exemplary embodiments described herein.

The instep strap assembly 120 comprises (i) a medial attachment strap 122 having a geometry-shifting proximal portion 123 and a distal portion 125, (ii) a padded center portion 130, and (iii) a lateral attachment strap 132 that may also include a proximal geometry-shifting portion 133.

The proximal portion 123 is configured to attach to the medial side of the heel loop 110. Preferably the medial attachment strap 122 is adjustably and/or pivotably attached to the heel loop 110, such that the angular orientation of the instep strap assembly 120 can be set by the user. The proximal portion 123 of the medial attachment strap 122 includes a pair of geometry-shifting elements 124, and a load-bearing center portion 140. The distal portion 125 is elongate and configured to adjustably attach to the padded center portion 130. For example, in a current embodiment the distal portion 125 includes a plurality of transverse serrations (not shown) on one side, i.e., a ladder strap.

Figure 2:
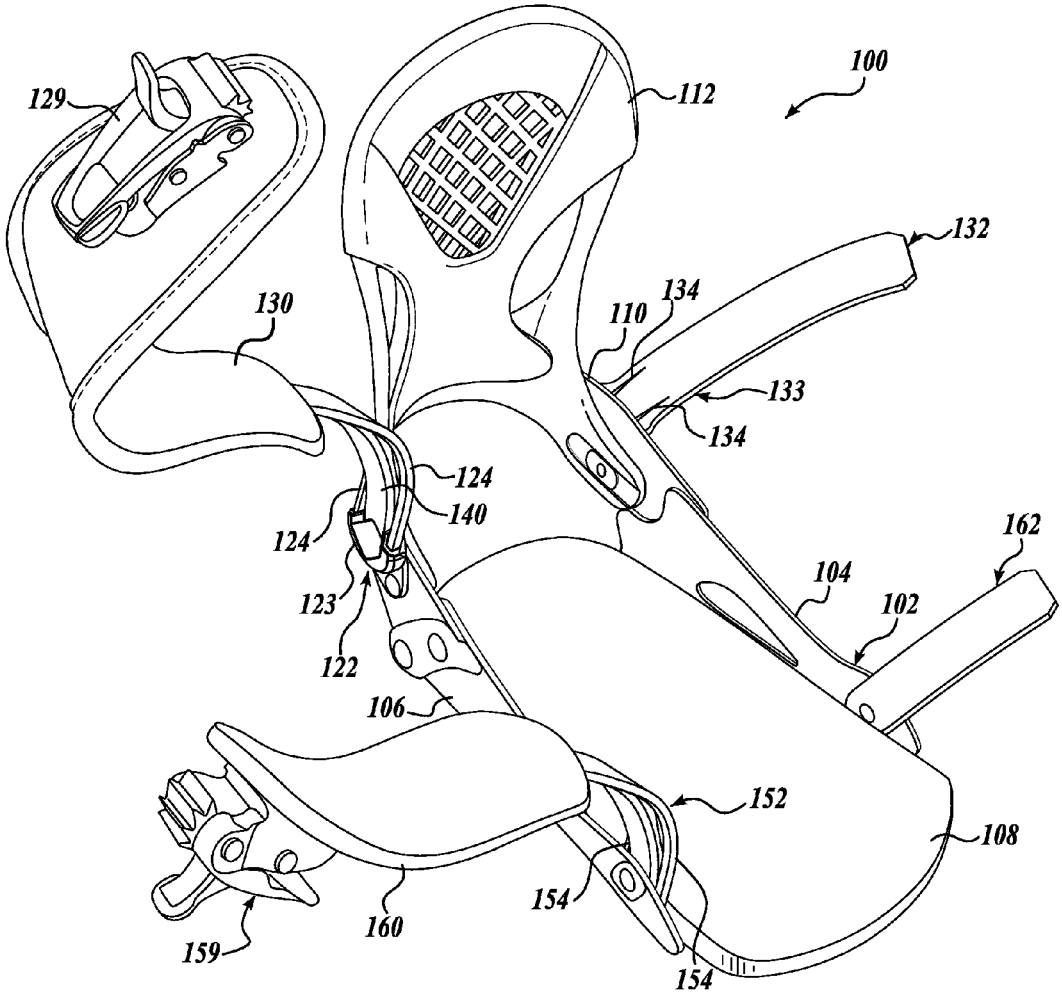
FIG. 2 is a perspective view of the snowboard binding shown in FIG. 1, showing the strap assemblies in the open position.

The padded portion 130 of the instep strap assembly 120 is shaped to generally conform to the contour of the boot, and adjustably attaches to the medial attachment strap 122 with a lever-type buckle assembly 127. The position of the padded portion 130 may be adjusted by opening a lever 128, sliding the buckle assembly 127 to a desired position along the medial attachment strap 122, and then closing the lever 128 to engage the strap 122 and lock the center portion 130 to the attachment strap 122. In this embodiment, the padded portion 130 also includes a ratchet-type buckle assembly 129 (see FIG. 2) that is positioned and configured to releasably engage the lateral attachment strap 132, wherein the buckle assembly 129 is operable to tighten the instep strap assembly 120 about the boot (not shown).

The lateral attachment strap 132 is sized and configured to engage the ratchet-type buckle assembly 129. The proximal portion 133 of the lateral attachment strap 132 is attached to the lateral sidewall 104. Preferably, the lateral attachment strap 132 is pivotably attached, to permit the user to adjust the position of the instep strap assembly 120. Optionally, the proximal portion 133 is configured similar to the proximal portion 123 of the medial attachment strap 122 to include geometry-shifting elements 134.

The toe strap assembly 150 similarly includes a medial attachment strap 152, a center portion 160, and a lateral attachment strap 162. The medial attachment strap 152 is attached to a forward portion of the medial sidewall 106, and includes a proximal portion having geometry-shifting elements 154. The distal portion 155 of the medial attachment strap 152 is configured to adjustably engage a lever-type buckle assembly 157 on the center portion 160. The lateral attachment strap 162 is configured to adjustably engage a ratchet-type buckle assembly 159 on the center portion 160.

The geometry-shifting elements 124, 134, 154 function as spring elements such that the associated strap is biased either towards a closed position, which is herein defined to be a position wherein the distal end of the strap is disposed directly over the baseplate assembly 102, and an open position, which is herein defined to be a position wherein the distal end of the strap is not directly over the baseplate assembly 102.

Figure 3A:
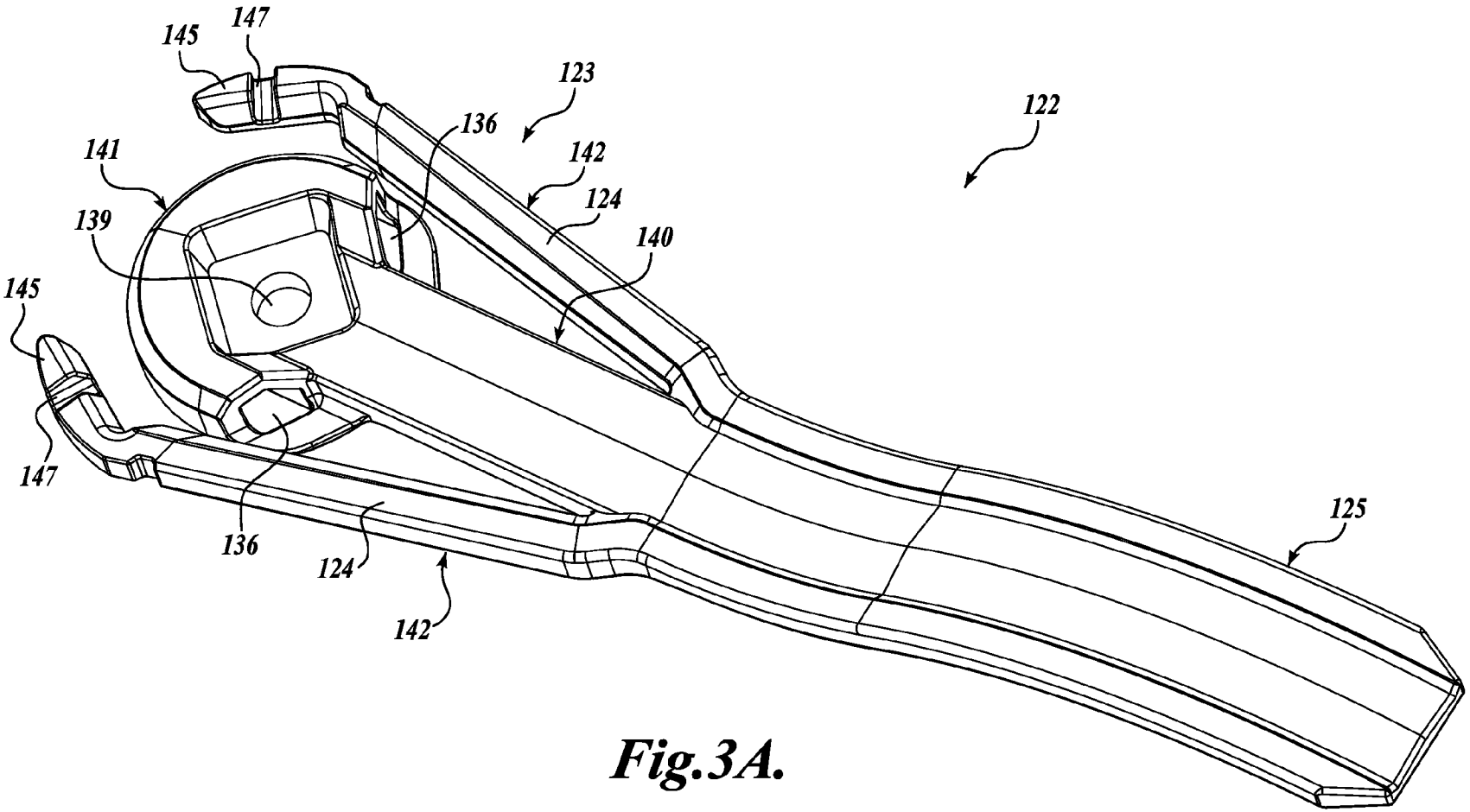
FIG. 3A is a top perspective view of the instep assembly medial attachment strap shown in FIG. 1, prior to being assembled for use.
Figure 3B:
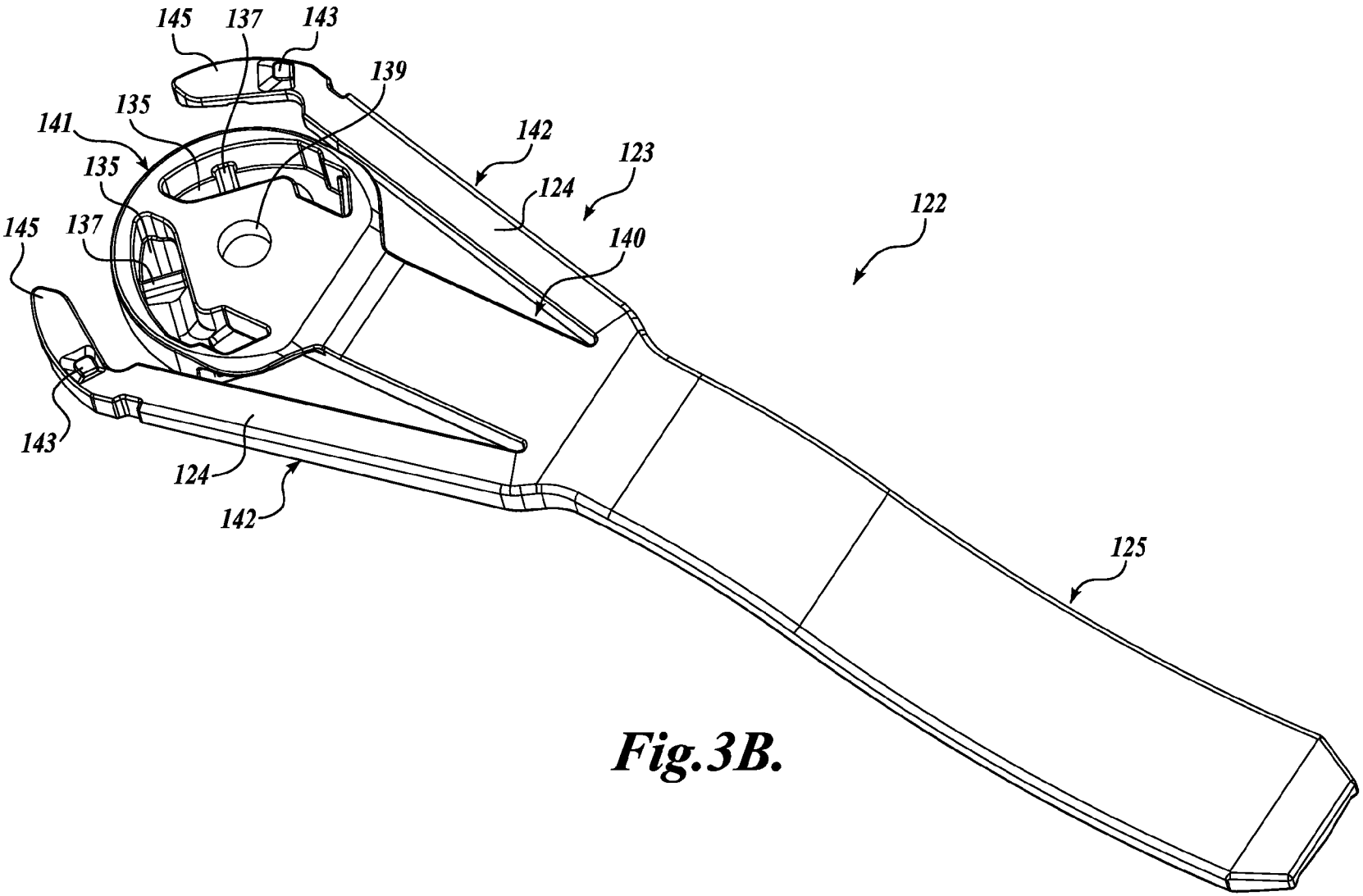
FIG. 3B is a bottom perspective view of the strap shown in FIG. 3A.

Refer now to FIG. 3A, which shows a top perspective view of the medial attachment strap 122, hereinafter the "strap 122." Refer also to FIG. 3B showing a bottom perspective view of the strap 122. The strap 122 is one-piece construction, and is shown in FIGS. 3A and 3B prior to assembling the strap 122 for use. The strap 122 comprises a unitary, flexible member that may be formed, for example, of thermoplastic polyurethane, by injection molding or the like. The distal portion 125 of the strap 122 adjustably engages a conventional buckle, for example, buckle assembly 127. The strap 122, and in particular the distal portion 125, may be molded with a curved profile to more closely conform to the user's boot.

The proximal portion 123 includes the load-carrying center portion 140 extending from the distal portion 125, a head 141 extending from the center portion 140, and a pair of oppositely disposed arms 142. The head 141 includes a mounting aperture 139 for attachment to the baseplate assembly 102. The head 141 also defines two recesses 135 that are open at the bottom (FIG. 3B) and have an open forward end 136 (FIG. 3A). Each recess 135 further defines a transverse locking ridge 137. Each arm 142 includes an elongate geometry-shifting element 124 that extends from the distal portion 125, and an angled foot portion 145 that is sized and shaped to be received into the corresponding recess 135 in the head 141. The angled foot portion 145 defines a transverse channel 147 on an upper side and a projection or boss 143 on a bottom side.

Figure 4:
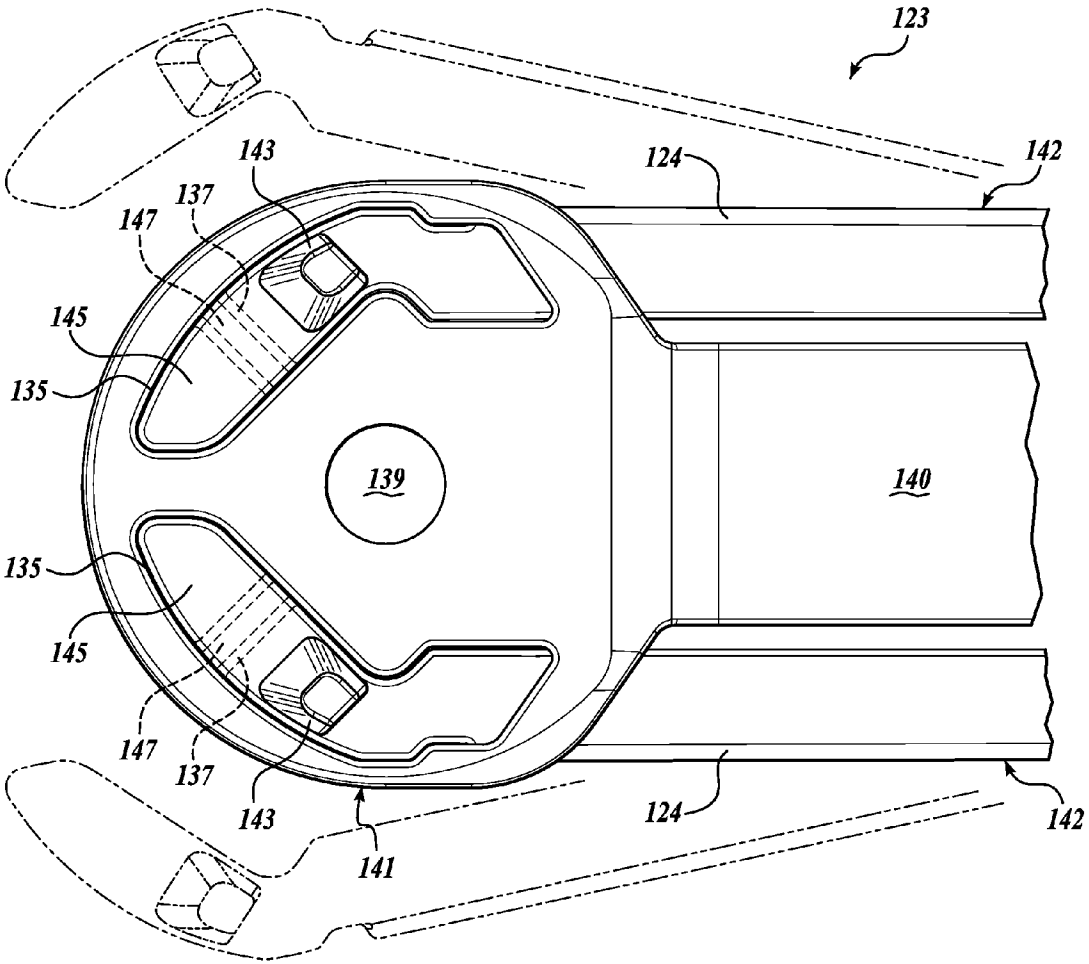
FIG. 4 is a fragmentary bottom view of the proximal portion of the strap shown in FIG. 3A.

The arms 142 are sufficiently flexible, and the shape of each foot portion 145 is configured such that the foot portions 145 can be inserted through the open forward end 136 of the corresponding recess 135. FIG. 4 is a fragmentary bottom view of the proximal portion 123 of the strap 122 with the foot portions 145 received into the corresponding recesses 135. When fully inserted, the transverse channel 147 of each foot portion 145 engages the transverse ridge 137 of the corresponding recess 135. When the strap 122 is installed, the boss 143 holds the foot portion 145 upwardly into the recess 135, such that the ridge 137 and channel 147 lockingly engage, preventing the foot portion 145 from being inadvertently pulled out of the recess 135.

It will be appreciated from FIGS. 3A and 4 that the arms 142 are longer than necessary to fully insert the foot portions 145 into the recesses 135. Therefore when the strap 122 is assembled as indicated in FIG. 4 the geometry-shifting elements 124 forming the elongate portion of the arms 142 must flex to accommodate the distance between the head 141 and the distal portion 125. The arms 142 are shaped such that geometry-shifting elements 124 will tend to flex into an arcuate shape either upwardly (e.g., convex) or downwardly (e.g., concave) with respect to a plane defined by the center portion 140.

Figure 5A:
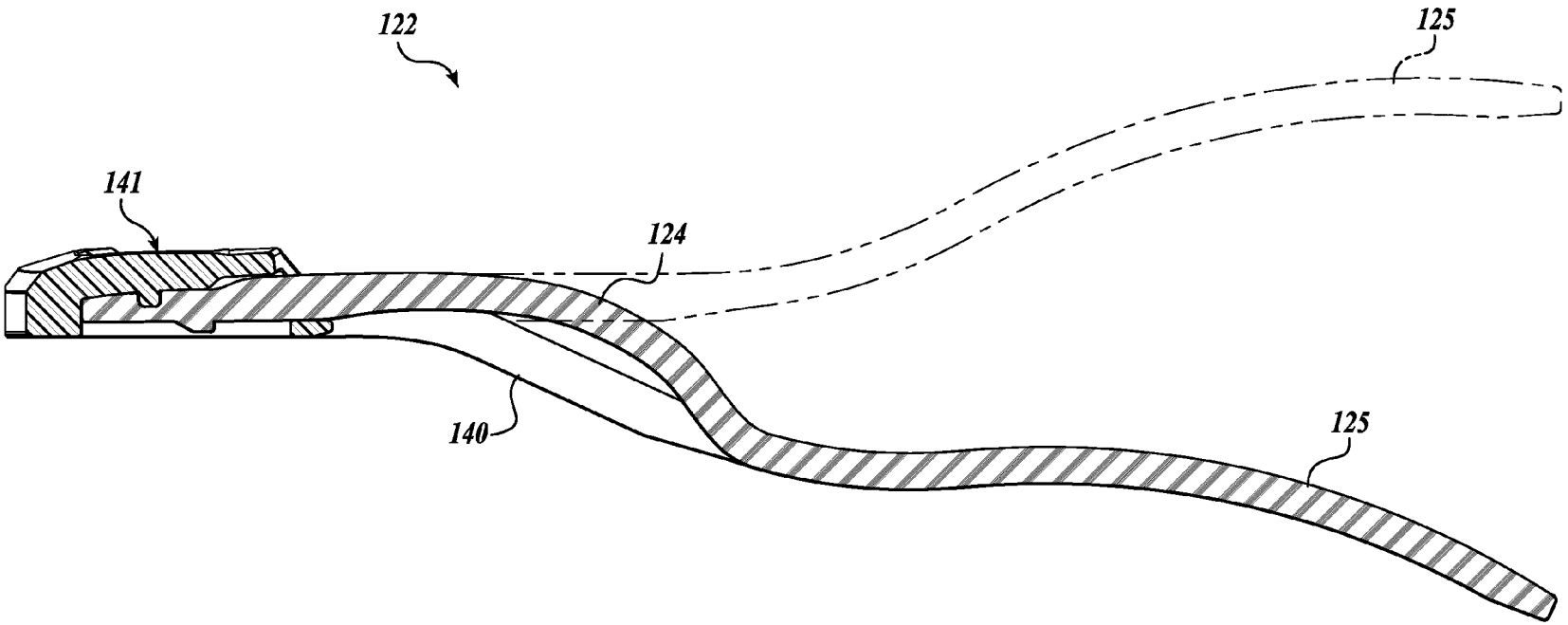
FIG. 5A shows a side view of the geometry-shifting strap shown in FIG. 1, shown in the closed position.

FIG. 5A is a cross-sectional side view of the strap 122, shown in isolation, and in the closed position. The shape of the unassembled strap 122 is shown in phantom, for reference. In the closed position the geometry-shifting elements 124 are curved concave downwardly in the figure, and act as spring elements biasing the distal portion 125 downwardly towards a first neutral position determined primarily by the relative lengths of the geometry-shifting elements 124 and the load-bearing center element 140. It will be apparent by comparing FIG. 5A with FIG. 1 that when the strap 122 is installed on the binding 100, and is placed in this closed position, the distal end of the strap 122 will be disposed directly over the baseplate assembly 102.

Figure 5B:
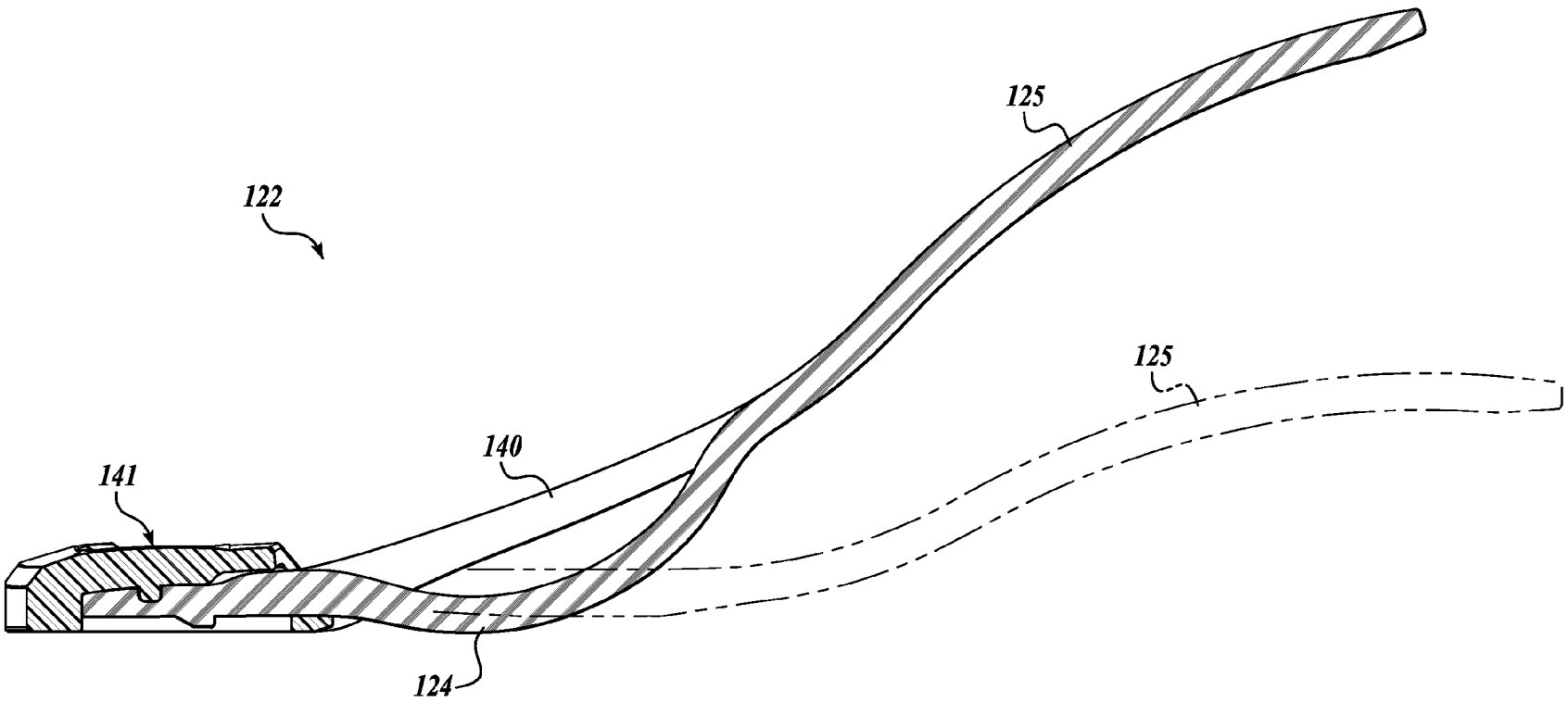
FIG. 5B shows a side view of the strap shown in FIG. 1, shown in the open position.

FIG. 5B is a cross-sectional side view of the assembled strap 122, shown in isolation, in the open position. In the open position the geometry-shifting elements 124 are curved concave upwardly (in the figure) and act as spring elements biasing the distal portion 125 upwardly towards a second neutral position. It will be apparent by comparing FIG. 5B with FIG. 2 that in this open position the end of the distal end of the strap 122 will not be disposed directly over the baseplate assembly 102.

Therefore, the strap 122, which in this embodiment is a single unitary structure, may be selectively biased towards either of two different neutral positions ("open" or "closed"). Typically, the user simply moves the strap far enough towards (or past) one of the first and second neutral positions. At some point the geometry-shifting elements 124 will assume the desired concavity direction, and will bias the strap towards the selected neutral position. So, for example, a snowboard rider preparing to reenter the binding after hiking to the top of a slope simply pushes the strap 122 towards or past the open position shown in FIG. 5B. The strap 122 will tend to stay in the open position due to the biasing effect of the elements 124, allowing the rider to clear off and step onto the baseplate assembly 102 without interference from the strap 122 (or the attached center portion 130). The rider may then move the strap 122 towards the closed position shown in FIG. 5A. The elements 124 will shift concavity, e.g., from concave to convex, and the strap 122 will then tend to stay biased towards the closed position, allowing the rider to easily fasten the lateral attachment strap 132 to the ratchet-type buckle assembly 159.

Another advantage of the strap 122 over prior art straps is that the strap may be designed to provide additional cushioning and/or protection from breakage. For example, during use the forces on the resilient strap 122 may be sufficient to elastically stretch the center portion 140. It will be appreciated that the strap 122 may be designed such that at a given elongation of the center portion 140 the arm portions 142 will begin to react some of the applied forces.

Some or all of the other straps 132, 152, 162 may also be constructed to include a geometry-shifting element such that the strap can be moved between a closed position and an open position.

Although the strap 122 is currently preferred, it will be appreciated by persons of skill in the art that a similar geometry-shifting, two-position strap may be made by forming the arm portions 142 of the strap 122 to be shorter such that the center portion 140 of the strap 122 will flex into an arcuate shape when the foot portions 145 are inserted into the recesses 135. In this alternative embodiment, the center portion 140 would shift its geometry from convex upwardly or convex downwardly to bias the strap between an open and closed position.

Other constructions of straps with geometry-shifting elements will be apparent to persons of skill in the art, in view of the teachings herein. Some exemplary alternative embodiments are described below.

Figure 6A:
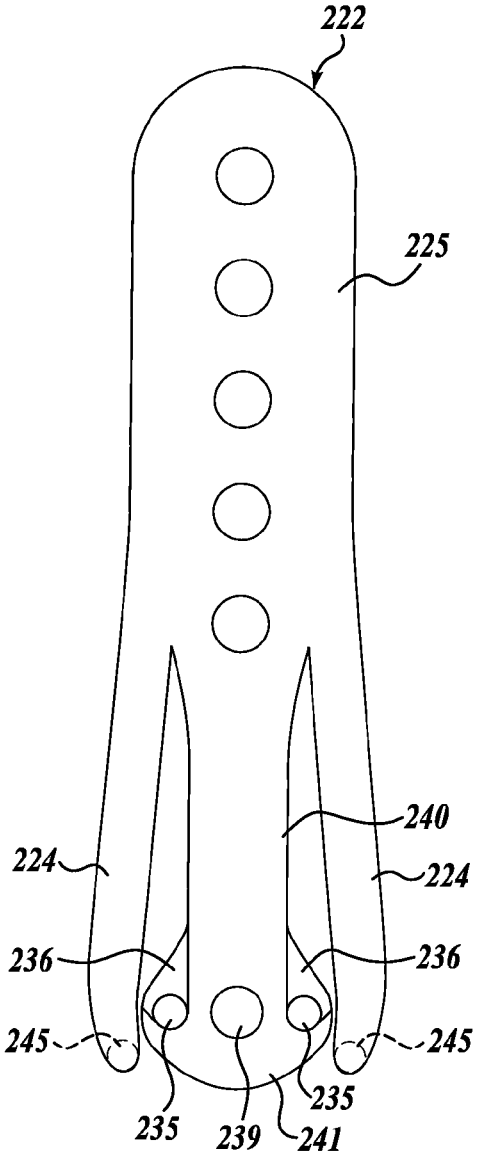
FIGS. 6A-6D show a second embodiment of a geometry-shifting strap in accordance with the present invention.
Figure 6B:
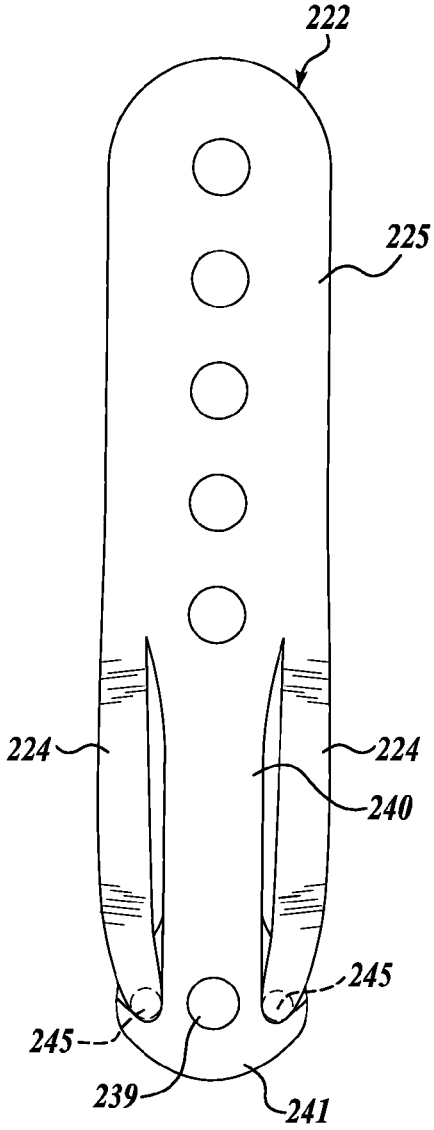

FIGS. 6A-6D illustrate a second embodiment of a strap 222 having geometry-shifting elements that selectively bias the strap towards either a closed position or an open position. FIG. 6A shows a bottom view of the strap 222 prior to assembly. A distal portion 225 is provided with a plurality of apertures for adjustable attachment to a center portion (not shown). The proximal portion of the strap 222 includes a load-bearing center portion 240, a head 241, and a pair of geometry-shifting elongate arms 224. The assembled strap 222 is shown in FIG. 6B. The strap 222 is similar to the strap 122 described above, but uses a simplified head 241 and arm 224 construction. The head 241 includes a pair of apertures 235 that are each disposed in a corresponding recess 236. The distal end of the arms 224 are formed with a projection or post 245 that is sized to be inserted into, and retained in, one of the apertures 235. A mounting aperture 239 is also provided in the head 241. The length of the arms 224 require that the arms 224 flex when the post 245 is inserted into the aperture 235. Therefore, the arms 224 act as spring elements.

Figure 6C:
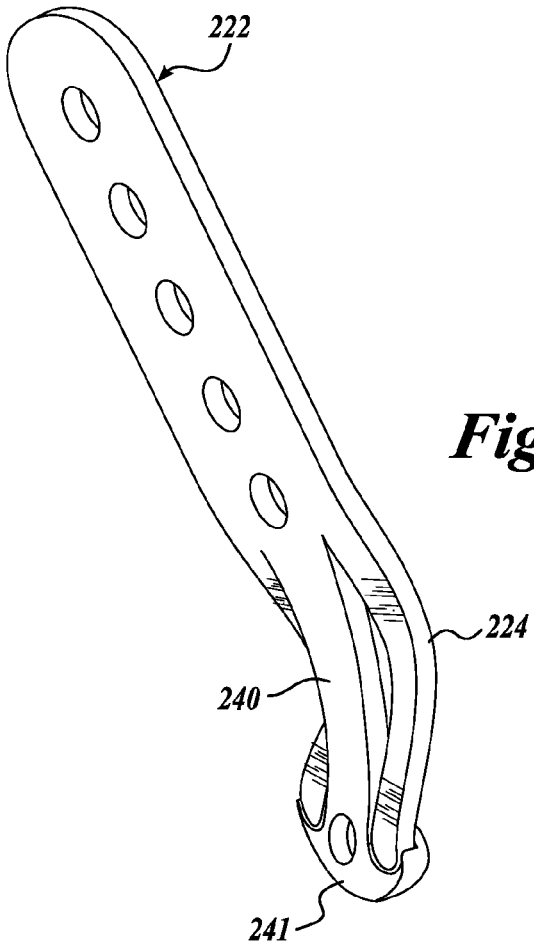
Figure 6D:
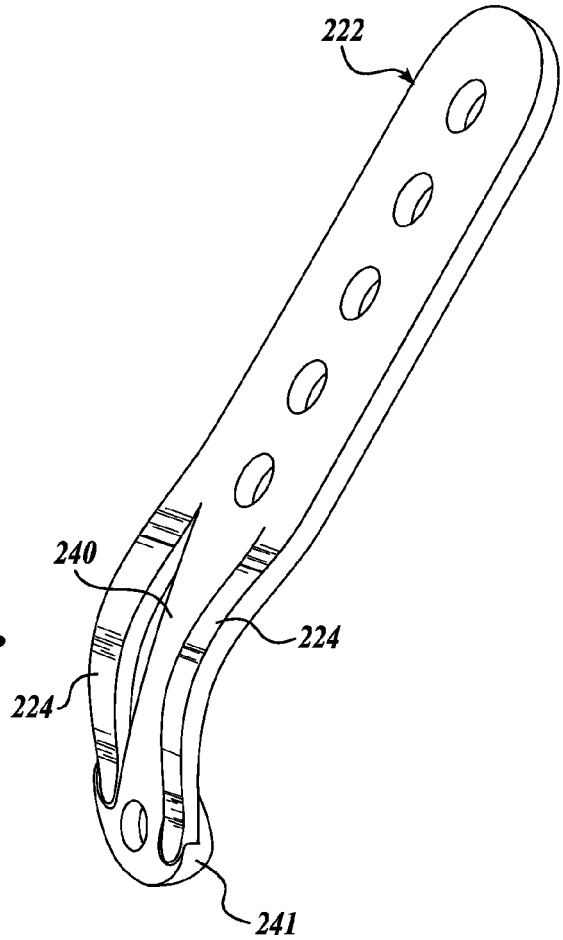

FIG. 6C shows the strap 222 in the neutral closed position, and FIG. 6D shows the strap 222 in the neutral open position. It should be appreciated that alternatively, the arms 224 could be formed shorter than the center portion 240, such that the center portion will flex when the posts 245 are inserted into the apertures 235. In this alternative construction, the arms 224 would at least initially function as load bearing members, and the center portion 240 would function as the spring member. Of course, as discussed above, during use the load bearing member may elastically extend sufficiently that the spring member also becomes load-bearing. Reversal of the longer and shorter elements may similarly be incorporated into other embodiments disclosed herein, without departing from the present invention.

Figure 7A:
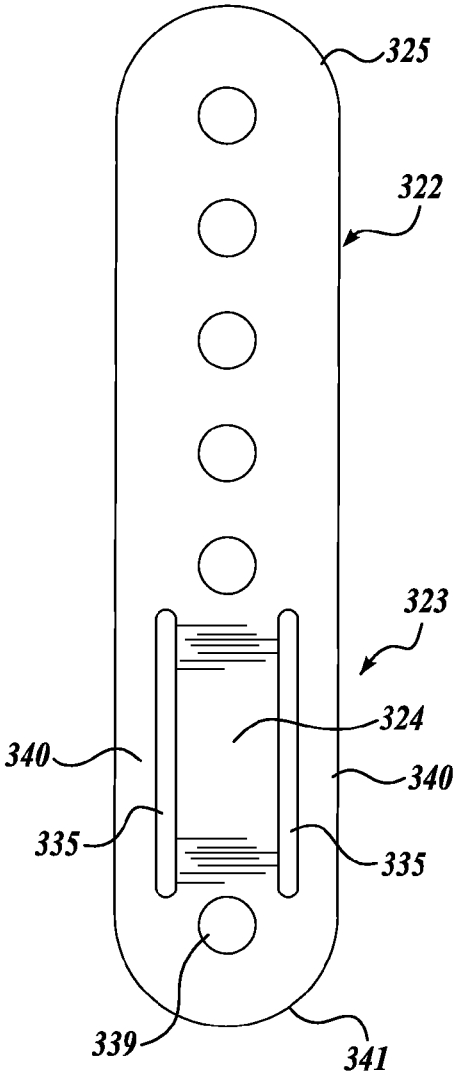
FIGS. 7A-7B show a third embodiment of a geometry-shifting strap in accordance with the present invention.
Figure 7B:
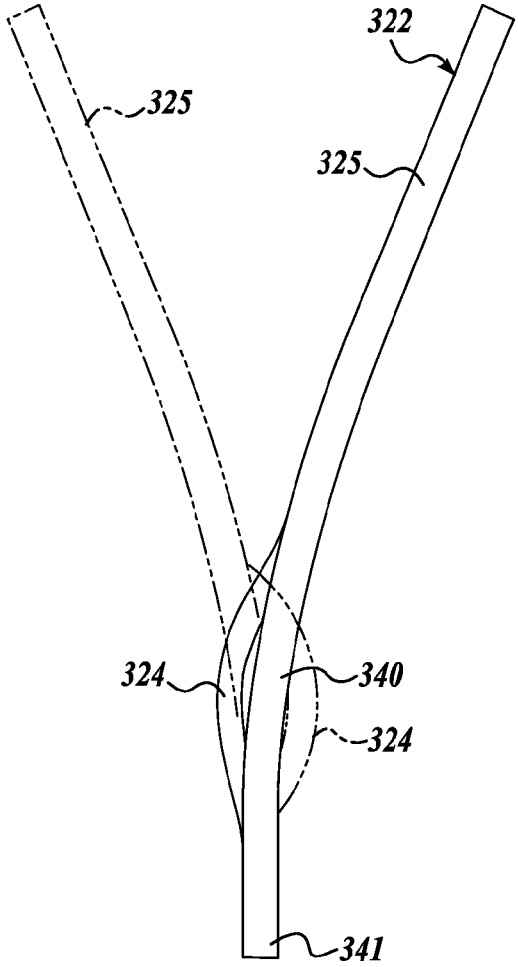

FIGS. 7A and 7B illustrate a third embodiment of a strap 322 having a geometry-shifting element. FIG. 7A shows a plan view of the strap 322. The distal portion 325 includes a plurality of apertures, and the proximal portion 323 includes a pair of spaced apart, elongate slots 335 that delimit a pair of outer arms 340 from a center portion 324. The strap 322 is formed such that the center portion 324 is arcuate, and bows away from the flattened strap 322. For example, the strap 322 may be injection molded as a unitary structure, with the center portion 324 molded in an arcuate shape. The head portion 341 of the strap 322 includes a mounting aperture 339.

FIG. 7B shows the strap 322 in the neutral open position, and in phantom shows the strap 322 in the neutral closed position.

Figure 8A:
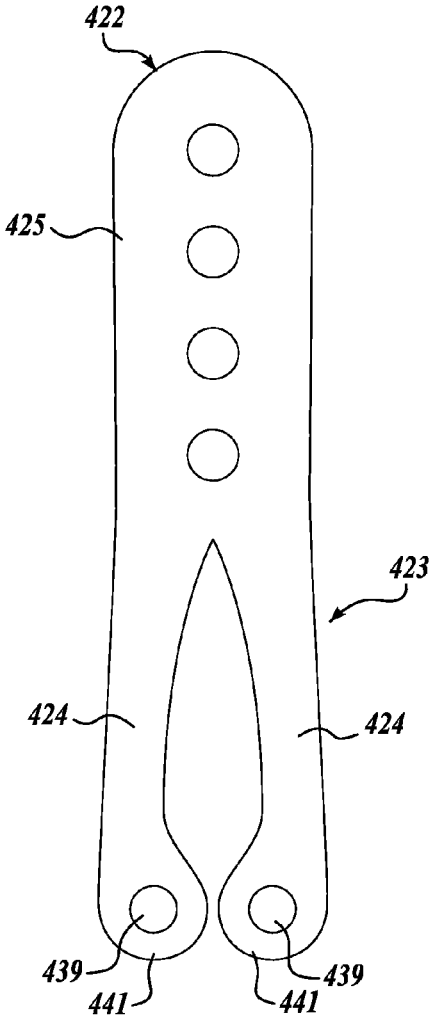
FIGS. 8A-8D show a fourth a embodiment of a geometry-shifting strap in accordance with the present invention.
Figure 8B:
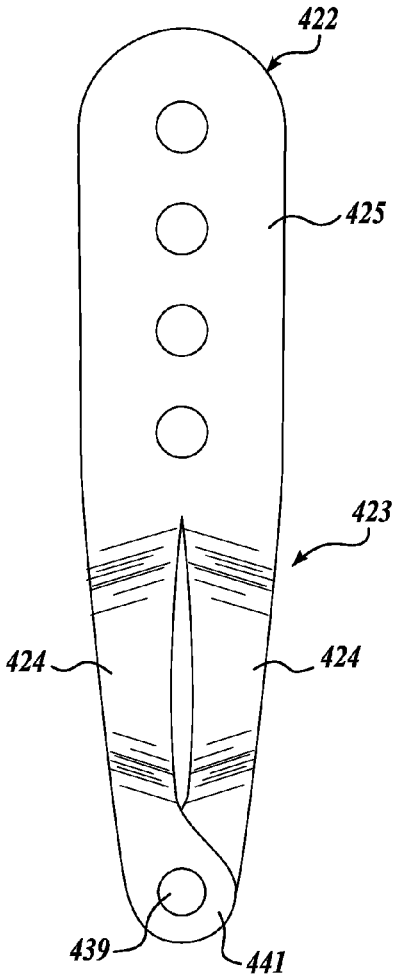

FIGS. 8A-8D show a fourth embodiment of a strap 422 having a geometry-shifting element. FIG. 8A shows a plan view of the strap 422 prior to assembly, and FIG. 8B shows the strap 422 configured for use. The strap 422 includes a distal portion 425, and a bifurcated proximal portion 423 comprising two elongate arms 424, each with head portions 441 having corresponding spaced apart mounting apertures 439. This strap is installed by flexing the arms 424 together until the mounting apertures 439 are aligned and adjacent each other. A mounting pivot such as a bolt (not shown) extends through the adjacent apertures 439 to secure the strap 422 to a baseplate assembly 102.

Figure 8C:
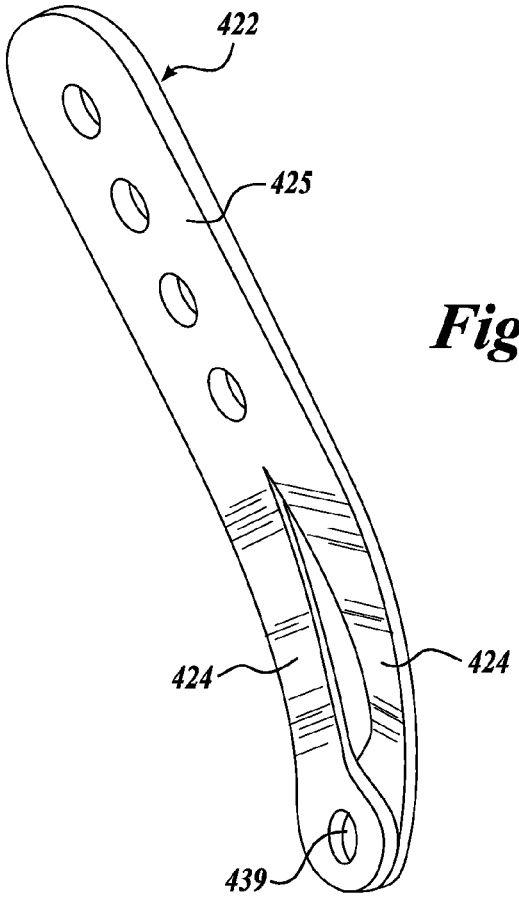
Figure 8D:
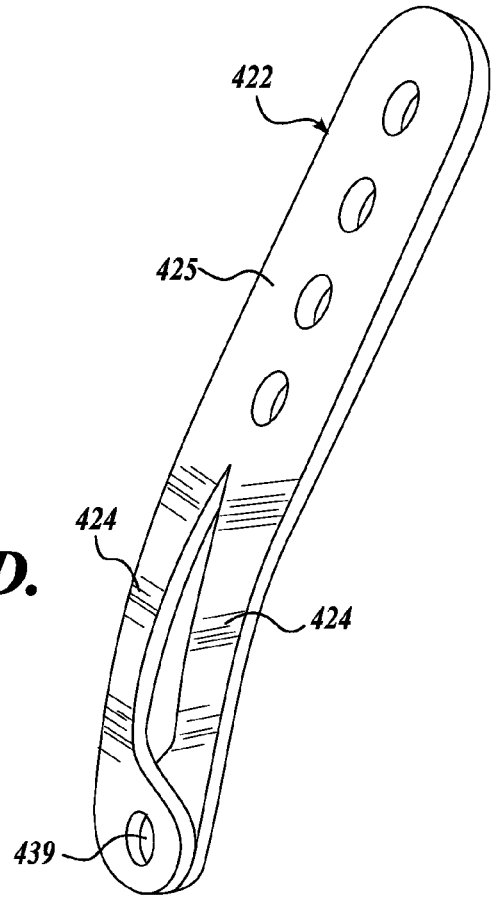

It will be appreciated that the flexed arms 424 will bow due to the flexure required to align the mounting apertures 439. As illustrated in FIGS. 8C and 8D the bowed arms 424 may be moved between two different neutral positions. The strap 424 is attached to the binding such that in the neutral closed position shown in FIG. 8C the distal end of the strap 422 will be disposed over the baseplate, and in the neutral open position shown in FIG. 8D the distal end of the strap 422 is not over the baseplate.

Figure 9A:
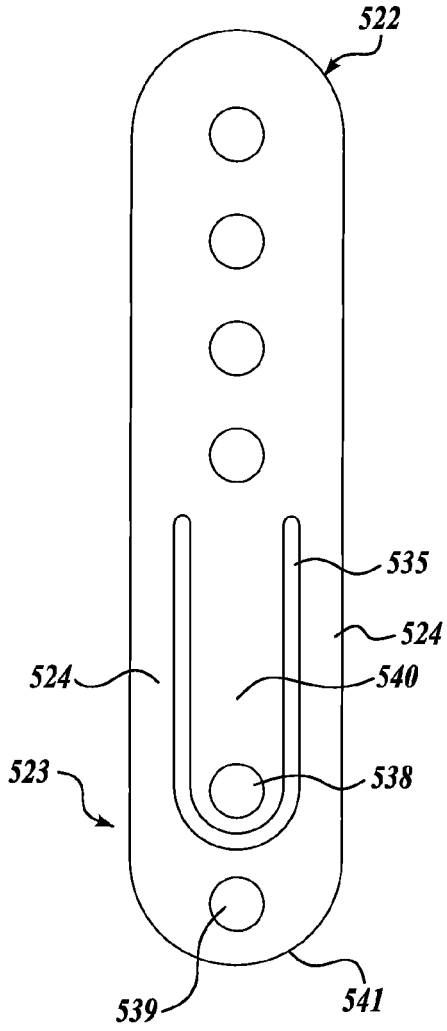
FIGS. 9A-9D show a fifth embodiment of a geometry-shifting strap in accordance with the present invention.
Figure 9B:
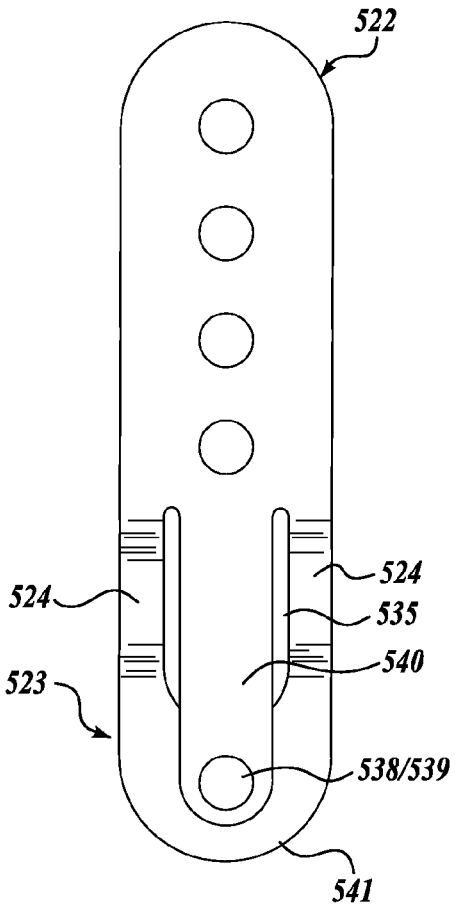
Figure 9C:
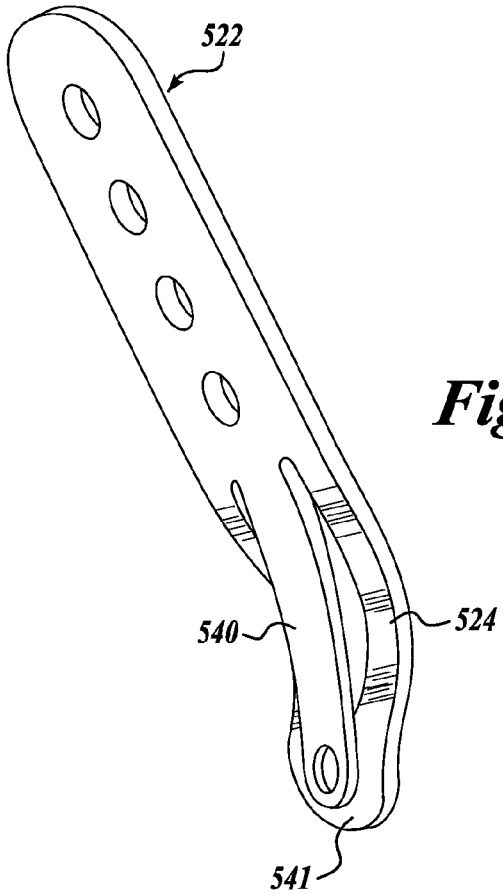
Figure 9D:
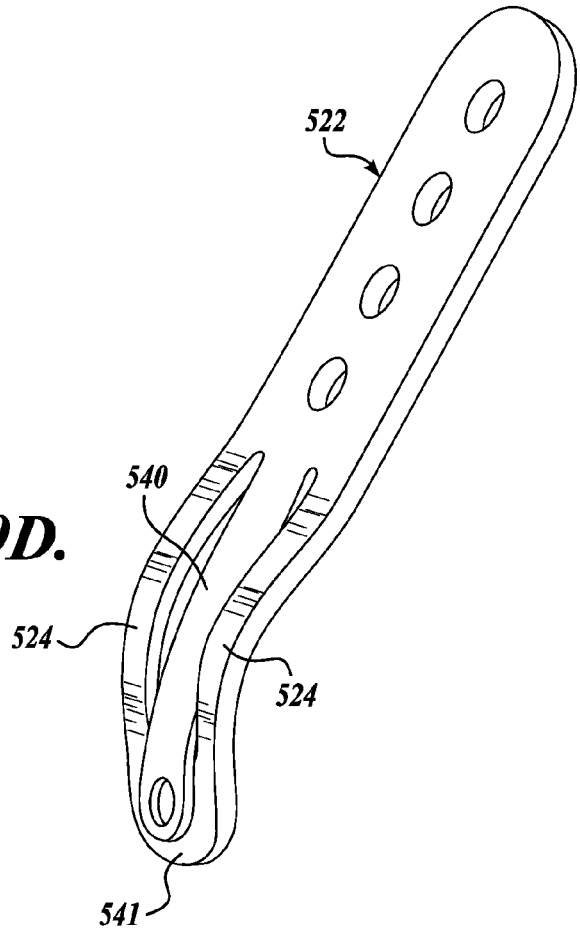

FIGS. 9A-9D show a fifth embodiment of a strap 522 having a geometry-shifting element. FIG. 9A shows a plan view of the strap 522 before assembly for use, and FIG. 9B shows a plan view of the strap configured for use. The proximal portion 523 of the strap 522 includes an elongate U-shaped slot 535 that delimits a center portion 540 from oppositely disposed arms 524. A head portion 541 is disposed below the center portion 540. A mounting aperture 539 is defined in the head portion 541, and a similar mounting aperture 538 is formed near the proximal end of the center portion 540. As shown in FIG. 9B, when assembled the head portion 541 is moved up such that the mounting apertures 538/539 are aligned and overlapping. Of course, this requires the arms 524 to flex into an arcuate shape. FIGS. 9C and 9D show the strap 522 in the neutral open and neutral closed positions, respectively.

While illustrative embodiments have been illustrated and described, it will be appreciated that various changes can be made therein without departing from the spirit and scope of the invention.

The embodiments of the invention in which an exclusive property or privilege is claimed are defined as follows:

1. A strap for a snowboard binding having a baseplate comprising:

an elongate distal portion and a proximal portion comprising a head configured to be attached to a binding baseplate, a load-bearing portion connecting the elongate distal portion with the head, and at least one geometry-shifting element that extends from the elongate distal portion to the head;

wherein the geometry-shifting element is configured to shift between (i) a concave geometry wherein the geometry-shifting element biases the distal portion towards a closed position wherein a distal end of the distal portion is disposed over the baseplate, and (ii) a convex geometry wherein the geometry-shifting element biases the distal portion towards an open position;

and further wherein the at least one geometry-shifting element comprises an elongate arm having a foot portion, and the head defines a recess that is open at a front end and is sized and shaped to receive and retain the foot portion of the elongate arm.

2. The strap of claim 1, wherein the strap is formed as a single, unitary structure.

3. The strap of claim 1, wherein the head further comprises a transverse locking element disposed across the recess, and the foot portion further comprises a complementary transverse locking element that engages the locking element disposed across the recess.

4. The strap of claim 1, wherein the at least one geometry-shifting element comprises a pair of oppositely disposed elongate arms, each arm having a foot portion, and further wherein the head defines a pair of recesses that are configured to lockingly receive a corresponding one of the pair of elongate arms, wherein the elongate arms are curved when the foot portions are retained in the recesses.

5. A strap for a snowboard binding having a baseplate comprising:

an elongate distal portion and a proximal portion comprising a head configured to be attached to a binding baseplate, a load-bearing portion connecting the elongate distal portion with the head, and at least one geometry-shifting element that extends from the elongate distal portion to the head;

wherein the geometry-shifting element is configured to shift between (i) a concave geometry wherein the geometry-shifting element biases the distal portion towards a closed position wherein a distal end of the distal portion is disposed over the baseplate, and (ii) a convex geometry wherein the geometry-shifting element biases the distal portion towards an open position;

wherein the load-bearing portion comprises a pair of spaced apart arms extending from the distal portion to the head, and wherein the geometry-shifting element is disposed between the pair of spaced apart arms.

6. The strap of claim 5, wherein the pair of spaced apart arms are formed by a pair of parallel elongate slots in the proximal portion of the strap.

7. A strap for a snowboard binding having a baseplate comprising:

an elongate distal portion and a proximal portion comprising a head configured to be attached to a binding baseplate, a load-bearing portion connecting the elongate distal portion with the head, and at least one geometry-shifting element that extends from the elongate distal portion to the head;

wherein the geometry-shifting element is configured to shift between (i) a concave geometry wherein the geometry-shifting element biases the distal portion towards a closed position wherein a distal end of the distal portion is disposed over the baseplate, and (ii) a convex geometry wherein the geometry-shifting element biases the distal portion towards an open position;

wherein the load-bearing portion is defined by an elongate U-shaped slot in the proximal portion of the strap, wherein the head defines a mounting aperture, and the load-bearing portion defines a mounting aperture, and further wherein when the strap is assembled the head mounting aperture and the load-bearing portion mounting aperture are aligned and adjacent each other.

8. A strap assembly for a strap-type snowboard binding of the type having a baseplate, a heel loop, and a highback, the strap assembly comprising: (i) a medial mounting strap, (ii) a center strap portion with a buckle assembly, the center strap portion being adjustably attached to the medial mounting strap, and (iii) a lateral mounting strap configured to releasably engage the buckle assembly;

wherein at least one of the medial mounting strap and the lateral mounting strap comprises a geometry-shifting strap having a distal portion configured to engage the center strap portion and a proximal portion comprising (i) a head configured to be attached to a binding baseplate, (ii) a load-bearing portion connecting the distal portion with the head, and (ii) a geometry-shifting element that extends from the distal portion to the head;

and wherein the geometry-shifting element is configured to be selectively shifted by the user between a closed position wherein the distal portion is biased towards the baseplate, and an open position wherein the distal portion is biased away from the baseplate;

and further wherein the geometry-shifting element comprises an elongate arm having a foot portion that is configured to be releasably attached to the head.

9. The strap assembly of claim 8, wherein the geometry-shifting element is an elongate arcuate arm that is concave in the closed position and is convex in the open position.

10. The strap assembly of claim 8, wherein the geometry-shifting strap is formed as a single, unitary structure.

11. The strap assembly of claim 8, wherein the elongate distal portion comprises a ladder strap.

12. The strap assembly of claim 8, wherein the head defines a recess that is open at a front end and is sized and shaped to receive and retain the foot portion of the elongate arm.

13. The strap assembly of claim 12, wherein the head further comprises a transverse locking element disposed across the recess, and the foot portion further comprises a complementary transverse locking element that engages the locking element disposed across the recess.

14. The strap assembly of claim 8, wherein the geometry-shifting element comprises a pair of oppositely disposed elongate arms, each arm having a foot portion, and further wherein the head defines a pair of recesses that are configured to lockingly receive a corresponding one of the pair of elongate arms, wherein the elongate arms are curved when the foot portions are retained in the recesses.

15. A strap assembly for a strap-type snowboard binding of the type having a baseplate, a heel loop, and a highback, the strap assembly comprising (i) a medial mounting strap, (ii) a center strap portion with a buckle assembly, the center strap portion being adjustably attached to the medial mounting strap, and (iii) a lateral mounting strap configured to releasably engage the buckle assembly;

wherein at least one of the medial mounting strap and the lateral mounting strap comprises a geometry-shifting strap having a distal portion configured to engage the center strap portion and a proximal portion comprising (i) a head configured to be attached to a binding baseplate, (ii) a load-bearing portion connecting the distal portion with the head, and (ii) a geometry-shifting element that extends from the distal portion to the head;

and wherein the geometry-shifting element is configured to be selectively shifted by the user between a closed position wherein the distal portion is biased towards the baseplate, and an open position wherein the distal portion is biased away from the baseplate;

wherein the load-bearing portion comprises a pair of spaced apart arms extending from the distal portion to the head, and wherein the geometry-shifting element is disposed between the pair of spaced apart arms.

16. The assembly strap of claim 15, wherein the pair of spaced apart arms are formed by a pair of parallel elongate slots in the proximal portion of the strap.

* * * * *